US010184701B2

(12) United States Patent
Sun et al.

(10) Patent No.: US 10,184,701 B2
(45) Date of Patent: Jan. 22, 2019

(54) MOTOR COOLING AND SUB-COOLING CIRCUITS FOR COMPRESSOR

(75) Inventors: Lin Sun, Tallahassee, FL (US); Paul D. Bishop, Tallahassee, FL (US); Huai Yu Lin, Tallahassee, FL (US); Jose Alvares, Tallahassee, FL (US); Ramesh Veerasurla, Troy, NC (US)

(73) Assignee: DANFOSS A/S (DK)

( * ) Notice: Subject to any disclaimer, the term of this patent is extended or adjusted under 35 U.S.C. 154(b) by 1002 days.

(21) Appl. No.: 14/345,034

(22) PCT Filed: May 8, 2012

(86) PCT No.: PCT/US2012/036868

§ 371 (c)(1),
(2), (4) Date: Mar. 14, 2014

(87) PCT Pub. No.: WO2013/039572

PCT Pub. Date: Mar. 21, 2013

(65) Prior Publication Data

US 2014/0345311 A1 Nov. 27, 2014

Related U.S. Application Data

(60) Provisional application No. 61/535,566, filed on Sep. 16, 2011.

(51) Int. Cl.

| | |
|---|---|
| ***F25B 1/00*** | (2006.01) |
| ***F25B 31/00*** | (2006.01) |
| ***F25B 40/02*** | (2006.01) |

(52) U.S. Cl.
CPC ..... *F25B 31/006* (2013.01); *F25B 1/005* (2013.01); *F25B 31/008* (2013.01); *F25B 40/02* (2013.01); *F25B 2400/13* (2013.01)

(58) Field of Classification Search
CPC .... F25B 2400/13; F25B 31/008; F25B 40/02; F25B 31/006
See application file for complete search history.

(56) References Cited

U.S. PATENT DOCUMENTS

| | | | | |
|---|---|---|---|---|
| 5,806,327 | A | 9/1998 | Lord et al. | |
| 5,884,498 | A | 3/1999 | Kishimoto et al. | |
| 6,182,467 | B1 * | 2/2001 | Zhong | F04C 29/025 62/470 |

(Continued)

FOREIGN PATENT DOCUMENTS

| | | |
|---|---|---|
| DE | 4122889 C1 | 12/1992 |
| GB | 1473086 A | 5/1977 |

(Continued)

OTHER PUBLICATIONS

International Search Report and Written Opinion dated Jul. 18, 2012.

(Continued)

*Primary Examiner* — Ana M Vazquez
(74) *Attorney, Agent, or Firm* — Carlson, Gaskey & Olds, P.C.

(57) ABSTRACT

The disclosed refrigerant system includes a compressor having a motor that is cooled by motor cooling fluid provided to the motor from the main refrigerant loop by a motor cooling circuit. The system also includes a sub-cooling circuit to cool the motor cooling fluid.

16 Claims, 6 Drawing Sheets

(56) References Cited

U.S. PATENT DOCUMENTS

| | | | | |
|---|---|---|---|---|
| 6,324,858 | B1 * | 12/2001 | Holden | F04D 13/06 310/53 |
| 6,651,451 | B2 | 11/2003 | Cho et al. | |
| 2007/0256432 | A1 | 11/2007 | Zugibe et al. | |
| 2009/0025405 | A1 | 1/2009 | Yanik | |
| 2011/0132007 | A1 | 6/2011 | Weyna et al. | |

FOREIGN PATENT DOCUMENTS

| | | | |
|---|---|---|---|
| JP | H02287058 | A | 11/1990 |
| JP | 2011047535 | A | 3/2011 |

OTHER PUBLICATIONS

Supplementary European Search Report for European Patent Application No. 12832508.1 dated Sep. 15, 2015.
International Preliminary Report for International Application No. PCT/US2012/036868 dated Mar. 27, 2014.

* cited by examiner

MOTOR COOLING AND SUB-COOLING CIRCUITS FOR COMPRESSOR

RELATED APPLICATIONS

This application claims the benefit of U.S. Provisional Application No. 61/535,566, filed 16 Sep. 2011.

BACKGROUND

Refrigerant systems are known to include a main refrigerant loop in communication with a compressor, a condenser, an evaporator, and an expansion device. Some compressors, such as centrifugal compressors, provide motor cooling by conveying refrigerant from the main refrigerant loop to the motor.

SUMMARY

An example of the disclosed refrigerant system includes a main refrigerant loop in communication with a condenser, an expansion device, an evaporator, and a compressor including at least one stage driven by a motor. Further included are motor cooling and sub-cooling lines. The motor cooling line conveys motor cooling fluid between the main refrigerant loop and the motor. The sub-cooling line conveys sub-cooling fluid between the main refrigerant loop and a sub-cooling heat exchanger in communication with the motor cooling line at a point upstream of the motor.

An example of the disclosed sub-cooling circuit includes a sub-cooling heat exchanger, and a sub-cooling line conveying a sub-cooling refrigerant between a main refrigerant loop and the sub-cooling heat exchanger. The sub-cooling heat exchanger is further in communication with a motor cooling line at a point upstream of a motor.

An example of the disclosed motor cooling circuit includes a motor cooling line conveying a motor cooling fluid between a main refrigerant loop and a motor. The motor cooling line further includes a pump to pressurize the motor cooling fluid.

These and other features of the present disclosure can be best understood from the following drawings and detailed description.

BRIEF DESCRIPTION OF THE DRAWINGS

The drawings can be briefly described as follows.

DETAILED DESCRIPTION

Figure 1A:
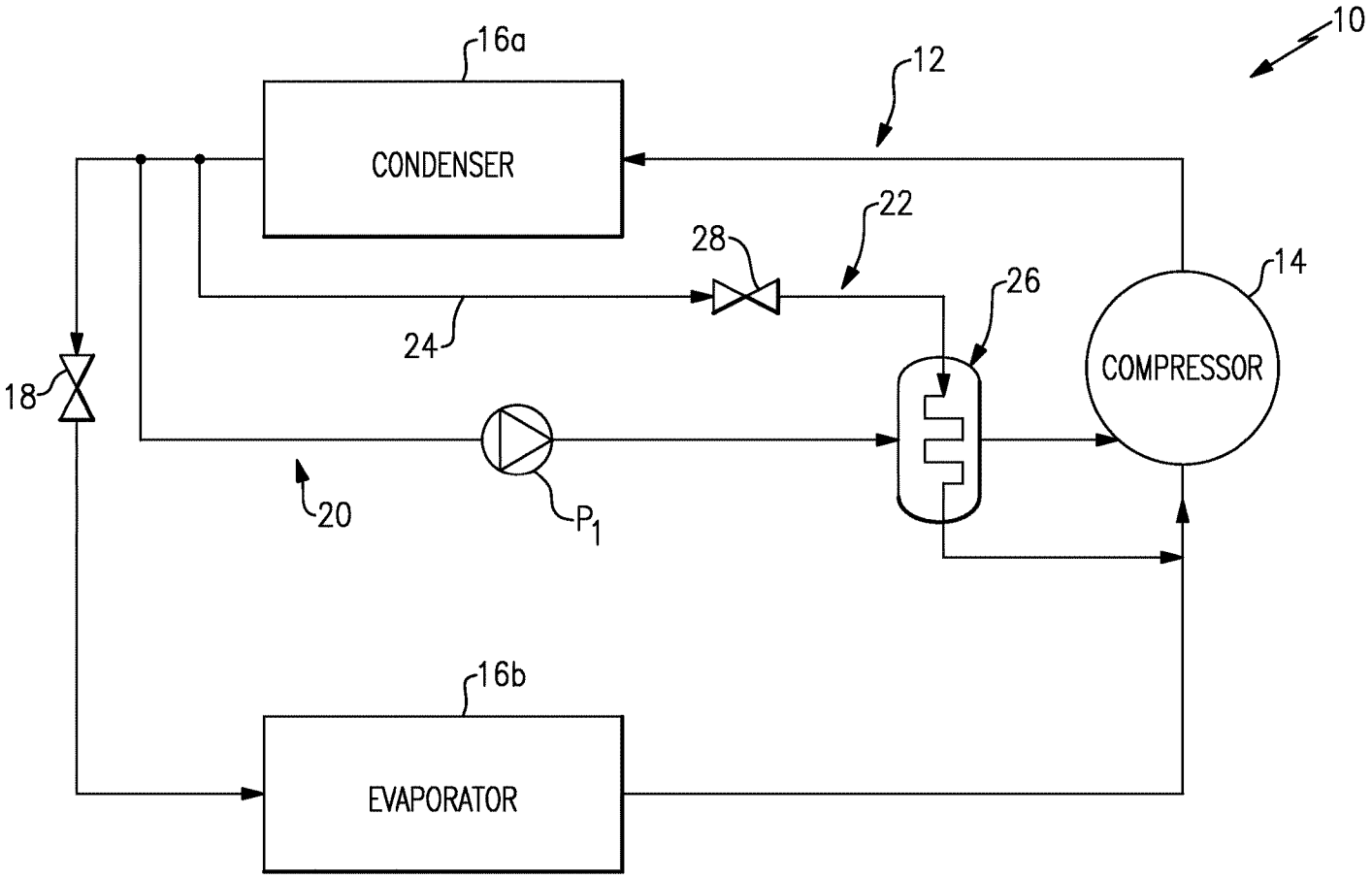
FIG. 1A illustrates an example of the disclosed refrigerant system.

With reference to FIG. 1A, an example of the disclosed refrigerant system 10 is illustrated. The refrigerant system 10 includes a main refrigerant loop, or circuit, 12 in communication with a compressor 14, a condenser 16A, an evaporator 16B, and expansion device 18. A motor cooling line 20 and a sub-cooling circuit 22 are branched from the main refrigerant loop 12. Notably, while a particular example of the refrigerant system 10 is shown, this application extends to other refrigerant system configurations. For instance, the main refrigerant loop 12 can include an economizer downstream of the condenser 16A and upstream of the expansion device 18.

The motor cooling line 20 conveys a motor cooling fluid between the main refrigerant loop 12 and the compressor 14. In particular, the motor cooling line 20 provides the motor cooling fluid to the motor of the compressor 14 as schematically illustrated in FIG. 1C, described in detail below. The motor cooling line 20 includes a pump $P_1$ to provide pressure to the motor cooling fluid. The motor cooling line 20 does not need a pump, however, and the pump $P_1$ could be removed altogether, or bypassed by a bypass line (e.g., bypass line 54 of the FIG. 2 embodiment). The motor cooling line 20 thus can be used to provide the motor of the compressor 14 with an adequate supply of motor cooling fluid at compressor start-up, at which time there is often not enough motor cooling fluid available to the motor (and/or the associated power electronics), for example.

While the motor cooling line 20, alone, is effective in providing motor cooling fluid to the compressor, and for cooling the motor, in some examples it is desirable to further cool (or sub-cool) the motor cooling fluid. Accordingly, the sub-cooling circuit 22 can optionally be provided to cool the motor cooling fluid, which in turn leads to more effective, and increased, motor cooling.

The sub-cooling circuit 22 includes sub-cooling line 24 to convey a sub-cooling fluid between the main refrigerant loop 12 and a sub-cooling heat exchanger 26. The sub-cooling heat exchanger 26 is in communication with the motor cooling line 20 at a point upstream of the compressor 14 (i.e., upstream of the motor 40 of the compressor). In this example, the sub-cooling circuit 22 further includes a sub-cooling expansion device 28 upstream of the sub-cooling heat exchanger 26 to cool the sub-cooling fluid relative to the motor cooling fluid. The sub-cooling expansion device 28 need not be present, as in the examples of FIGS. 3-4.

Figure 1B:
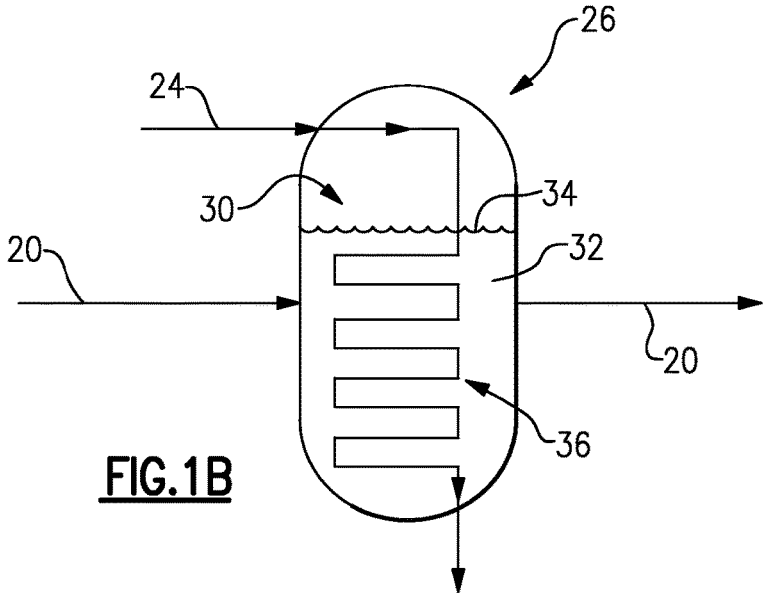
FIG. 1B schematically illustrates an example sub-cooling heat exchanger.
Figure 1C:
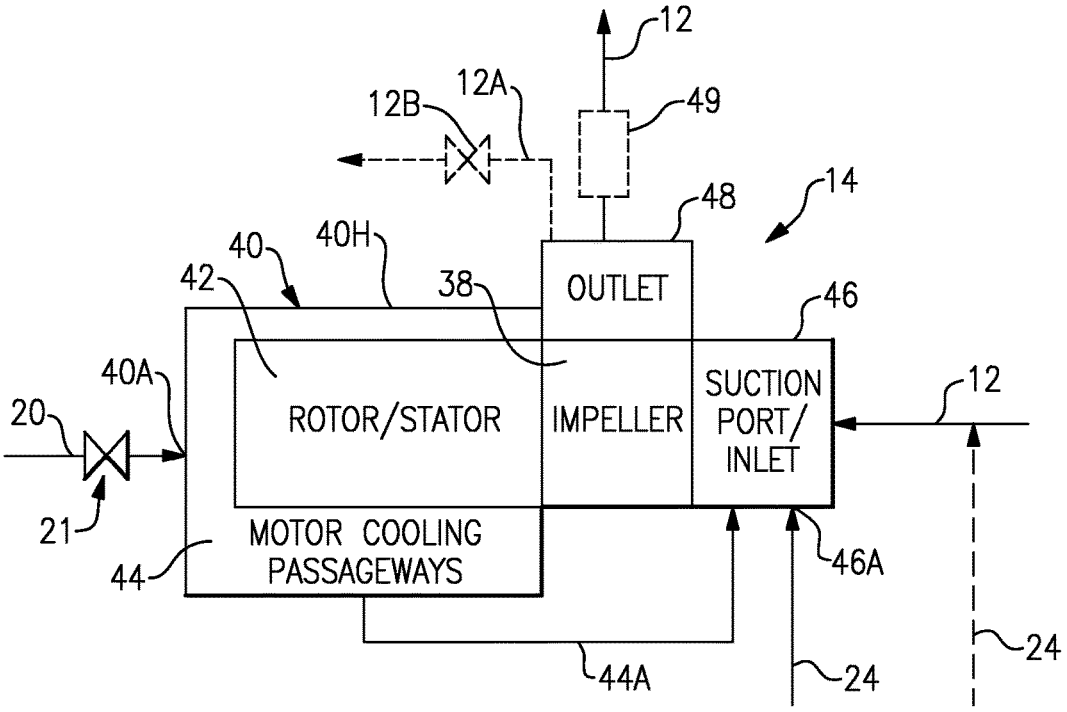
FIG. 1C schematically illustrates an example compressor.

An example sub-cooling heat exchanger 26 is shown in FIG. 1B. As illustrated, the sub-cooling heat exchanger 26 is in communication with both the sub-cooling line 24 and the motor cooling line 20. In the example, the sub-cooling heat exchanger 26 includes a reservoir 30 which holds an amount of motor cooling fluid 32 at a level 34 above a point where the motor cooling line 20 enters and exits the sub-cooling heat exchanger 26. The sub-cooling line 24 includes a number of coils 36 such that heat can effectively transfer between the motor cooling fluid 32 and the sub-cooling fluid. Notably, the sub-cooling heat exchanger 26 need not include a reservoir, and may be another type of heat exchanger.

An example of the compressor 14 is schematically illustrated in FIG. 1C. In this example, the compressor 14 is a centrifugal compressor having at least one stage provided by an impeller 38 that is driven by a motor 40. While a centrifugal compressor is shown, this application extends to other compressor types.

The motor 40 may include a housing 40H enclosing a rotor/stator 42 as well as motor cooling passageways 44. The housing 40H may be a common housing, also enclosing the remainder of the compressor 14, or may be a separate housing. The motor cooling passageways 44 are fed motor cooling fluid via an opening 40A provided by the housing 40H. Further included is a return passageway 44A (which may be (1) an auxiliary return pipe extending outside the housing 40H or (2) additional passageways within the housing 40H) to direct motor cooling fluid from the motor 40 to the suction port 46 of the compressor. Notably, an expansion valve 21 is positioned adjacent, and upstream, of the opening 40A to expand the motor cooling fluid before entry into the compressor 14. Alternatively, this expansion valve 21 could be positioned inside the compressor 14.

As the motor 40 drives the impeller 38, refrigerant from the main refrigerant loop 12 is drawn into a suction port, or inlet, 46 and is outlet from the compressor back to the main refrigerant loop 12 via an outlet 48. For purposes of this disclosure, "suction port" refers to a suction header, a suction pipe, or any other component of the suction line between the expansion valve 18 and the compressor 14. Notably, while only one impeller 38 is shown, this application extends to compressors with two or more compressor stages. In the example where there are two or more compressor stages, an economizer port 49 could be included between those stages, as illustrated schematically.

While the sub-cooling circuit 22 is shown returning to the main refrigerant loop 12 at a point upstream of the suction port 46 of the compressor (as shown in FIG. 1A), the suction port 46 of the compressor 14 can include an opening 46A dedicated to the sub-cooling line 24, as illustrated in FIG. 1C.

Figure 1D:
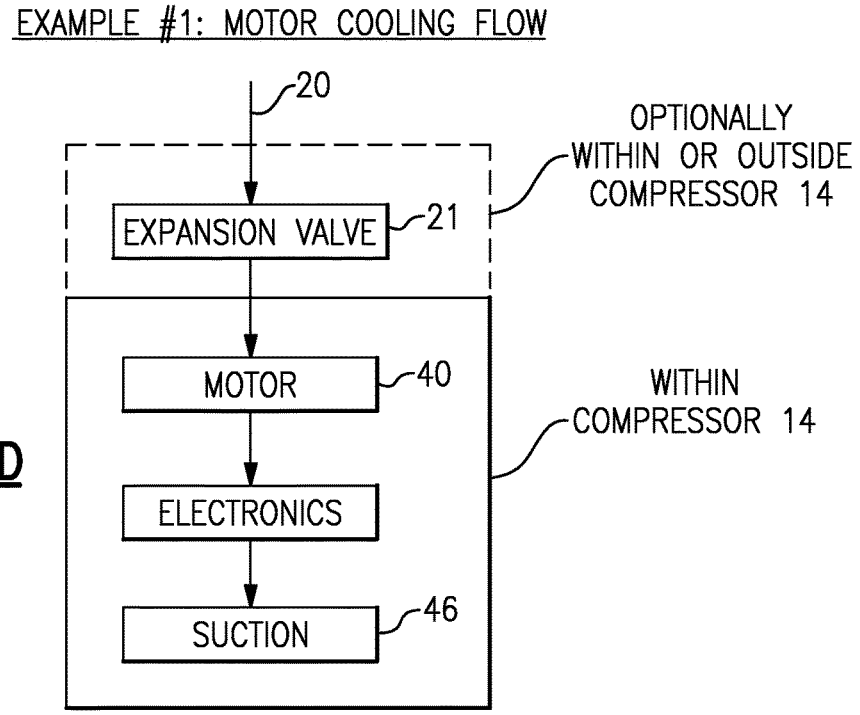
FIGS. 1D-1E schematically illustrate example flow paths for the motor cooling fluid.
Figure 1E:
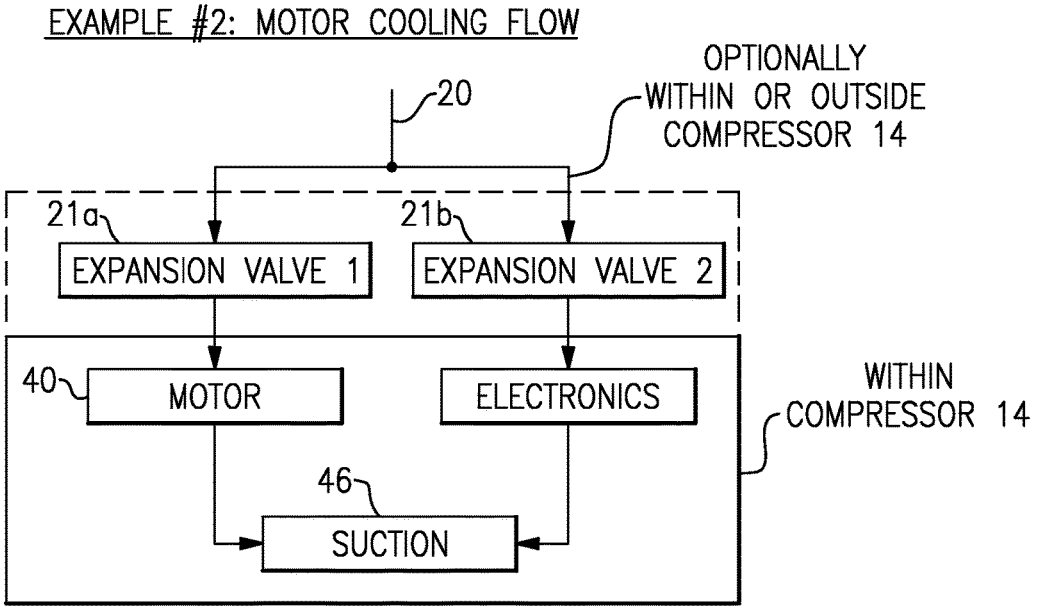

While FIG. 1C generally illustrates the compressor 14 and the various flow paths relative thereto, FIGS. 1D and 1E illustrate example flow paths of the motor cooling fluid in further detail. Referring to FIG. 1D, the motor cooling fluid could be guided, via the motor cooling line 20, toward an expansion valve 21, which may be within or outside the compressor 14 (as noted above), and then serially downstream to the motor 40 and electronics associated with the compressor 14 or the motor 40. Then, the motor cooling fluid returns to the suction port 46 of the compressor 14. Alternatively, as illustrated in FIG. 1E, the motor 40 and the electronics could be arranged in parallel, with the motor cooling fluid branching off to separately cool these components before returning to the suction port 46 of the compressor.

Figure 2:
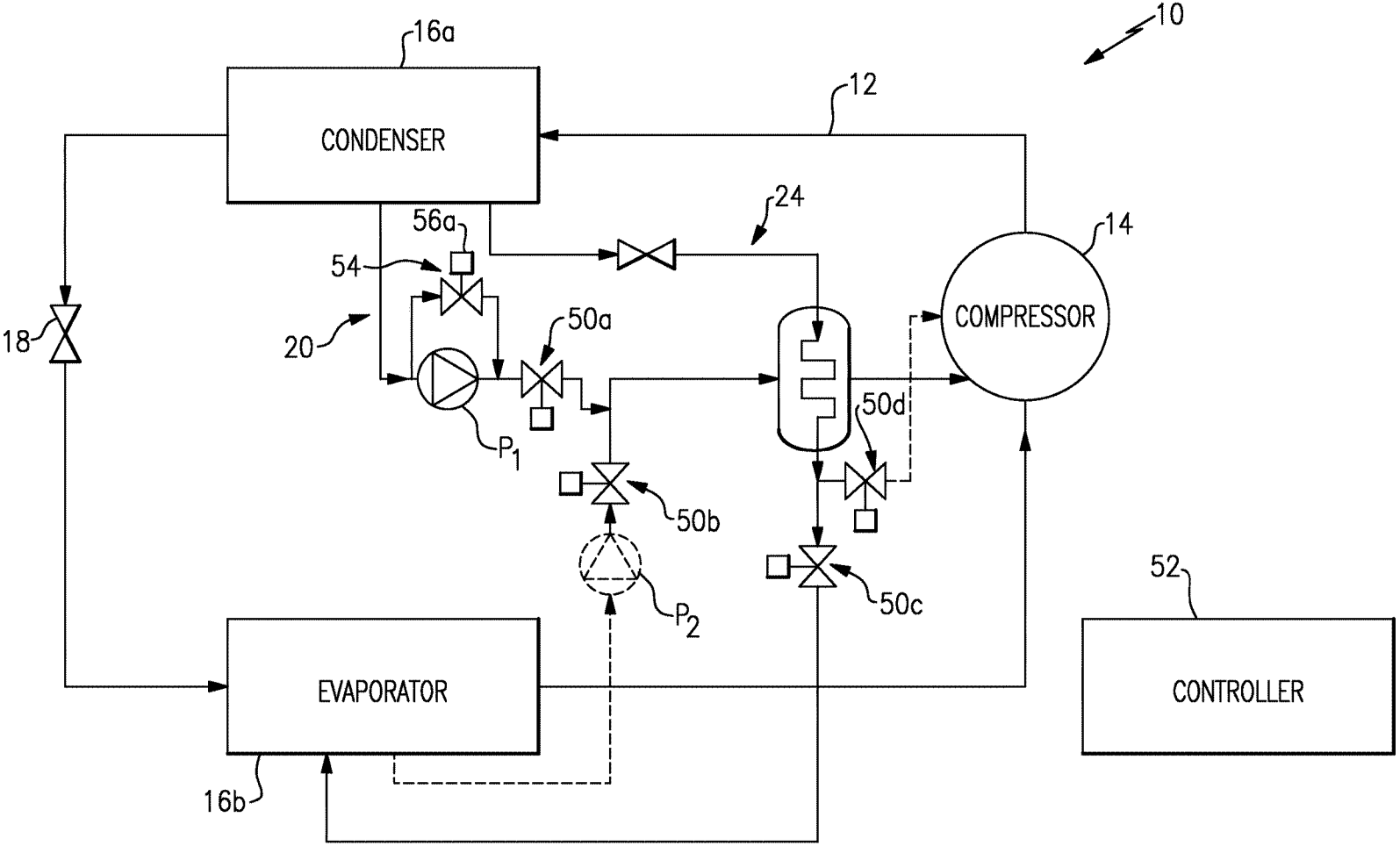
FIGS. 2-4 illustrate further examples of the disclosed refrigerant system.
Figure 3:
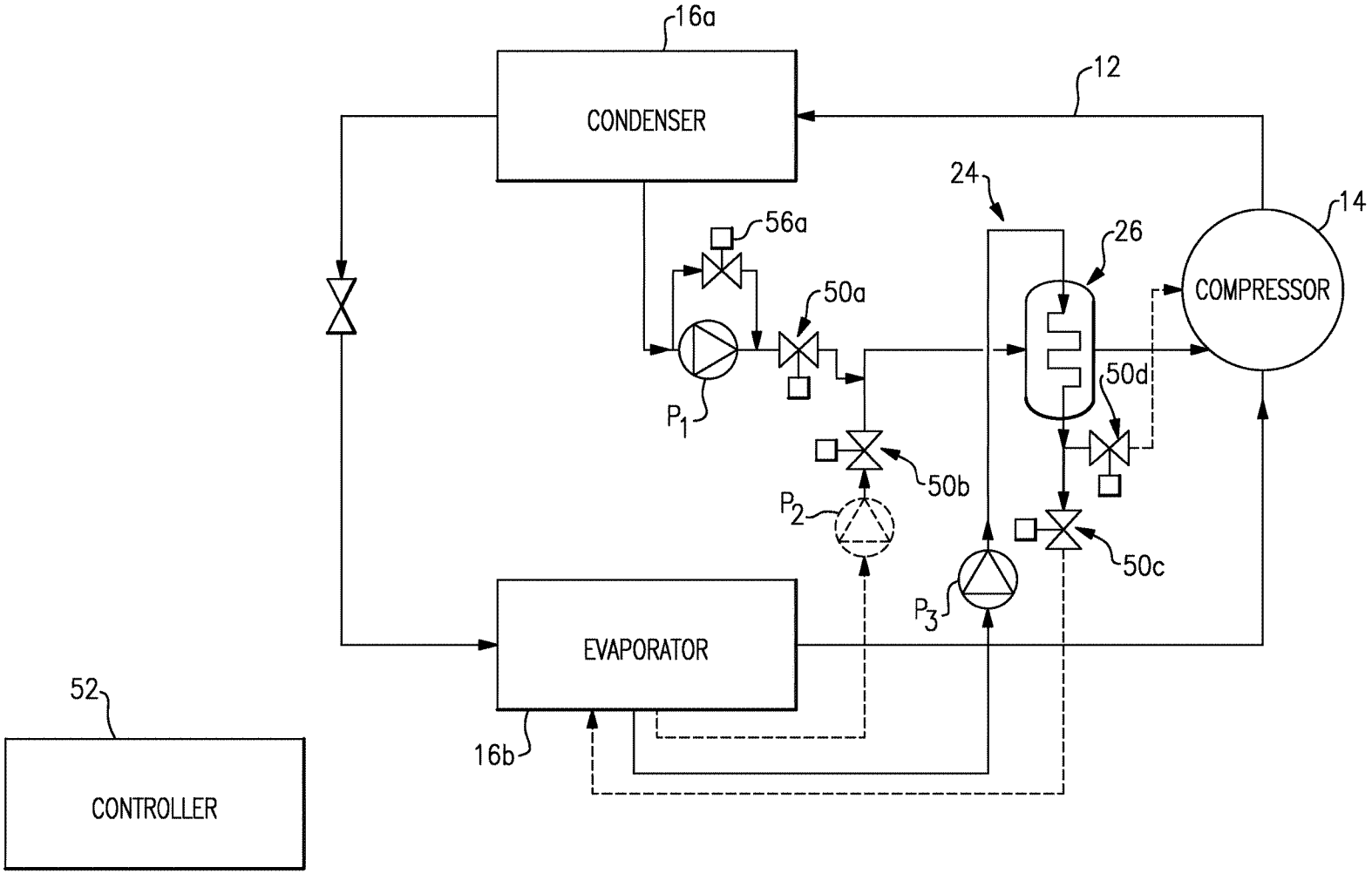
Figure 4:
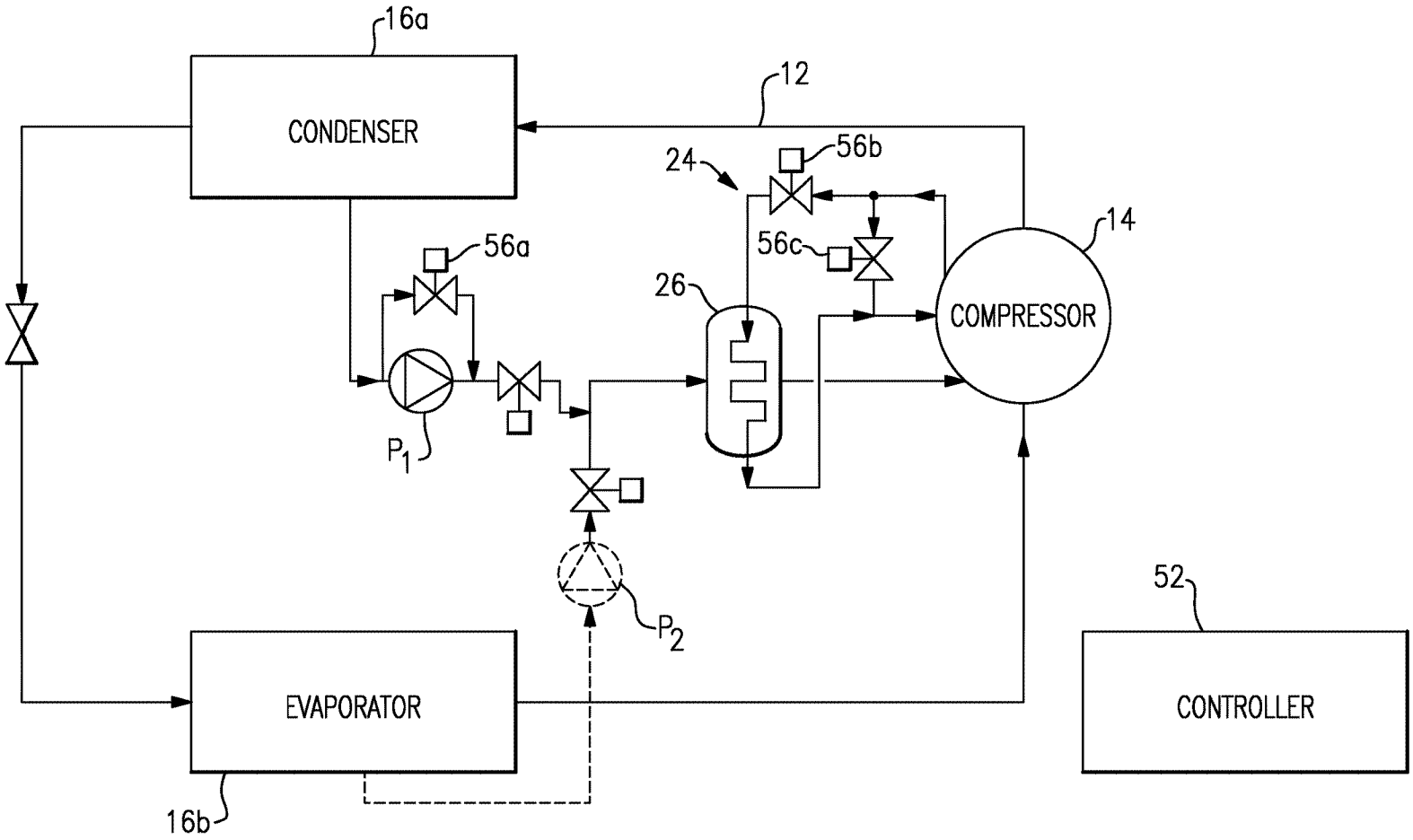

Whereas the example of FIG. 1A illustrates the sub-cooling circuit 22 and the motor cooling line 20 branched from the main refrigerant loop 12 at a point between the condenser 16A and the expansion device 18, the motor cooling line 20 and the sub-cooling circuit 22 may be branched from the main refrigerant loop 12 at different points, as schematically illustrated across the embodiments of FIGS. 2-4.

In the embodiment of FIG. 2, both the motor cooling line 20 and the sub-cooling circuit 24 are sourced from the condenser 16A, and the sub-cooling circuit 24 is returned to the main refrigerant loop 12 at the evaporator 16B.

The motor cooling line 20 and the sub-cooling circuit 24 are each in communication with a plurality of valves 50A-50D. Notably, while solenoid valves are shown, these valves 50A-50D could be check valves, or any other appropriate type of valve. Depending on which pump $P_1$, $P_2$ is active, the motor cooling line 20 could be sourced from the evaporator 16B instead of the condenser 16A (e.g., by operating pump $P_2$ and not $P_1$), and the sub-cooling circuit 24 could be returned to the compressor 14 via the opening of the valve 50D. These alternate paths are shown in phantom in FIG. 2.

In the example where the valves 50A-50D are solenoid valves, the valves 50A-50D may be in communication with a controller 52, either wirelessly or otherwise, which controls opening and closing of the valves 50A-50D. Notably, the pump $P_1$ of the motor cooling line 20 is arranged in parallel with a bypass line 54, including a solenoid valve 56A. If the pump $P_1$ is not needed to provide added pressure to the motor cooling fluid, then the solenoid valve 56A may be opened, allowing the motor cooling fluid to bypass the pump $P_1$. Operation of the solenoid valve 56A may be controlled by the controller 52. Notably, if the motor cooling line 24 is sourced from the evaporator 16B, the pump $P_2$ may be used to provide added pressure to the motor cooling fluid. While not illustrated, the pump $P_2$ could be arranged in parallel with a bypass line (similar to bypass line 54).

In the example of FIG. 3, the sub-cooling circuit 24 is sourced from the evaporator 16B. In this example, the sub-cooling circuit 24 includes a pump $P_3$ upstream of the sub-cooling heat exchanger 26 to provide additional pressure to the sub-cooling fluid. While not illustrated, the pump $P_3$ could be bypassed. Notably, the sub-cooling circuit 22 is returned to the main refrigerant loop 12 at the compressor 14, by way of the arrangement of the valves 50C-50D. In particular, the sub-cooling circuit 22 may be returned to the opening 46A illustrated in FIG. 1C. As additional examples, the sub-cooling circuit 22 could be returned upstream of the suction port 46 of the compressor, or to the economizer port 49 (if present). The portion of the sub-cooling circuit 22 downstream of the valve 50D is representative, generally, of the sub-cooling circuit 22 being in connection with an economizer port.

Notably, in the example of FIG. 3, the sub-cooling circuit need not include a sub-cooling expansion device 28 upstream of the sub-cooling heat exchanger 26. This is due to the nature of the fluid tapped from the evaporator 16B, which is already sufficiently cool (relative to the motor cooling fluid). An expansion device can be included if desired, however.

FIG. 4 illustrates an embodiment in which the sub-cooling circuit 24 is sourced from, and returns to, the compressor 14. The compressor 14 may house an internal fluid line 12A (shown schematically, and in phantom, in FIG. 1C) in communication with an internal expansion device 12B. The internal fluid line 12A may be located within a housing of the compressor 14.

In this example, the internal fluid line 12A is the source of the sub-cooling circuit 24. The sub-cooling circuit 24 may be in communication with one or more solenoid valves 56B-56C controlled by the controller 52 to meter the flow of sub-cooling fluid between the sub-cooling heating exchanger 26 and the compressor 14. Notably, the branch of the sub-cooling circuit associated with the solenoid valve 56C may be utilized to cool electronics associated with the compressor 14.

While the Figures illustrate various example sources for the sub-cooling circuit 24, it is further possible to source the sub-cooling circuit from an economizer, in the example where the main refrigerant loop 12 includes an economizer. In this example, the sub-cooling circuit 24 can be returned to either of the evaporator 16B, the suction port 46 of the compressor, or the economizer port 49 of the compressor.

It should be understood that the sub-cooling and motor cooling fluid may be a refrigerant, such as R-134a, and may be primarily in a liquid state when initially tapped from the main refrigerant loop 12. This application is not limited to R-134a, however, and could include any other type of refrigerant. Further, the tapping and returning of the sub-cooling and motor cooling fluid to the main refrigerant loop 12 may be done in any known manner to maximize the overall efficiency of the refrigerant system 10.

While the sub-cooling circuit 22 in the above examples has been discussed as being primarily useful for cooling the motor cooling line 20, the sub-cooling circuit 22 may optionally, or additionally, be used to provide cooling to other components in the refrigerant system 10. For example, the sub-cooling circuit 22 may be routed, or may include a separate branch, to cool electronics associated with the compressor 14 (as illustrated in FIGS. 1D-1E), and/or to cool the controller 52.

Although the different examples have the specific components shown in the illustrations, embodiments of this invention are not limited to those particular combinations. It is possible to use some of the components or features from one of the examples in combination with features or components from another one of the examples.

One of ordinary skill in this art would understand that the above-described embodiments are exemplary and non-limiting. That is, modifications of this disclosure would come within the scope of the claims. Accordingly, the following claims should be studied to determine their true scope and content.

What is claimed is:

1. A refrigerant system, comprising:

a main refrigerant loop in communication with a condenser, an expansion device, an evaporator, and a compressor driven by a motor;

a motor cooling line to convey a motor cooling fluid between the main refrigerant loop and the motor; and a sub-cooling line to convey a sub-cooling fluid between the main refrigerant loop and a sub-cooling heat exchanger, the sub-cooling heat exchanger in communication with the motor cooling line at a point upstream of the motor, and wherein the motor cooling line includes a pump upstream of the sub-cooling heat exchanger.

2. The refrigerant system as recited in claim 1, wherein the motor cooling fluid is cooled at the sub-cooling heat exchanger.

3. The refrigerant system as recited in claim 1, wherein the sub-cooling fluid is sourced from the condenser, and wherein the sub-cooling fluid is returned to the main refrigerant loop at one of the evaporator, a suction port of the compressor, and an economizer port of the compressor.

4. The refrigerant system as recited in claim 3, wherein the sub-cooling line includes a sub-cooling expansion device upstream of the sub-cooling heat exchanger.

5. The refrigerant system as recited in claim 1, wherein the sub-cooling fluid is sourced from the evaporator, and wherein the sub-cooling fluid is returned to the main refrigerant loop at one of the evaporator, a suction port of the compressor, and an economizer port of the compressor.

6. The refrigerant system as recited in claim 5, wherein the sub-cooling line includes a pump upstream of the sub-cooling heat exchanger.

7. The refrigerant system as recited in claim 1, wherein the sub-cooling fluid is sourced directly from the compressor, and wherein the sub-cooling fluid is returned to the main refrigerant line at a suction port of the compressor.

8. The refrigerant system as recited in claim 1, wherein the sub-cooling fluid is sourced from an economizer, and wherein the sub-cooling fluid is returned to the main refrigerant loop at one of the evaporator, a suction port of the compressor, and an economizer port of the compressor.

9. The refrigerant system as recited in claim 1, wherein the motor cooling fluid is sourced from one of the condenser and the evaporator.

10. The refrigerant system as recited in claim 1, wherein the motor cooling line is in communication with a reservoir, the reservoir configured to store an amount of motor cooling fluid.

11. The refrigerant system as recited in claim 1, wherein the motor cooling line includes a bypass line arranged in parallel with the pump.

12. The refrigerant system as recited in claim 11, wherein the bypass line includes a flow regulator configured to selectively allow fluid to bypass the pump.

13. A system, comprising:

a motor cooling line conveying a motor cooling fluid between a main refrigerant loop and a motor, wherein the motor cooling line includes a pump to pressurize the motor cooling fluid; and a sub-cooling line to convey a sub-cooling fluid between the main refrigerant loop and a sub-cooling heat exchanger, the sub-cooling heat exchanger in communication with the motor cooling line at a point upstream of the motor, wherein the pump of the motor cooling line is upstream of the sub-cooling heat exchanger.

14. The system as recited in claim 13, wherein the motor cooling fluid is sourced from one of a condenser and an evaporator.

15. The system as recited in claim 13, wherein the motor cooling fluid is sourced at a point downstream of a condenser and upstream of an expansion valve.

16. The system as recited in claim 13, wherein the motor cooling line includes a bypass line having a solenoid valve, the bypass line arranged in parallel with the pump, the solenoid valve configured to selectively allow fluid to bypass the pump.

* * * * *